US005377505A

United States Patent [19]

McVay, III

[11] Patent Number: 5,377,505

[45] Date of Patent: Jan. 3, 1995

[54] FINGERNAIL RING

[76] Inventor: Julian C. McVay, III, 6250 Streamside Dr. #63, Burlington, Ky. 41005

[21] Appl. No.: 143,109

[22] Filed: Oct. 29, 1993

[51] Int. Cl.[6] ..... A44C 9/00

[52] U.S. Cl. ..... 63/15; 63/15.1

[58] Field of Search ..... 63/15, 15.1, 15.2, 15.3; 411/161, 162, 163, 957

[56] References Cited

U.S. PATENT DOCUMENTS

| | | | |
|---|---|---|---|
| D. 59,236 | 10/1921 | Lapidus | 63/15 |
| D. 59,314 | 10/1921 | Winsen | 63/15 |
| D. 89,240 | 2/1933 | Kagan | 63/15 |
| D. 119,814 | 4/1940 | Whitehead | 63/15 |
| D. 137,991 | 5/1944 | Walker | 63/15 |
| 1,578,907 | 3/1926 | Naumburg | 63/15 |
| 1,600,241 | 9/1926 | Olson | 411/957 |
| 1,645,859 | 10/1927 | Hosking | 411/957 |
| 1,660,772 | 2/1928 | Swenson | 411/163 |
| 1,758,447 | 5/1930 | Liebs | 63/15.1 |
| 1,788,735 | 1/1931 | Olson | 411/457 |
| 1,841,669 | 1/1932 | Olson | 411/163 |
| 1,878,425 | 9/1932 | Olson | 411/163 |
| 2,016,679 | 10/1935 | Mayer | 63/15.1 |
| 2,073,228 | 3/1937 | Shields | 63/15 |
| 2,297,261 | 9/1942 | Thode | 411/163 |
| 4,351,166 | 9/1982 | Belin | 63/15 |
| 4,573,331 | 3/1986 | Wideman | 63/15 |

FOREIGN PATENT DOCUMENTS

| | | | |
|---|---|---|---|
| 4146703 | 5/1992 | Japan | 63/15 |

*Primary Examiner*—Michael J. Milano
*Attorney, Agent, or Firm*—Frost & Jacobs

[57] ABSTRACT

A ring with at least one notched or serrated edge to clean under the fingernail. The ring has a convex outer surface and a flat inner surface. The curve of the ring is dimmensioned so that it will conform to the size and shape of the nail. The thickness of convex outer side is dimensioned to prevent the ring from being inserted too far under the fingernail.

1 Claim, 1 Drawing Sheet

FINGERNAIL RING

FIELD OF THE INVENTION

This invention is in the field of personal hygiene instruments. More specifically it relates to an instrument used to clean under the fingernails.

1. Background of Invention

There are different instruments for cleaning under the fingernails. Two such instrument of prior invention are the nail file and the nail brush. The nail file is usually a fiat strip of abrasive metal with a pointed end used to clean under the nail. A nail brush is a small brush with the bristles used to clean and polish the top and under the nail.

2. Summary of Invention

It is an object of the present invention to provide an easier and more efficient instrument for the purpose of cleaning under the fingernail.

It is another object of the invention to fit and conform to the size and shape of the fingernail.

It is a further object or the invention to provide a means of accommodating a soap or cleaning solution for additional aid in cleaning under the fingernail.

Other objects will appear hereinafter.

In a preferred embodiment, the notched or serrated edge of the ring will slip under the fingernail. Once the notched or serrated edge is inserted under the fingernail, the ring can be angled to conform to the size and shape of the fingernail. The convex outer side of the ring prevents forcing the ring too far up under the fingernail. With a couple of rotations or twists of the ring about it's vertical axis, dirt and grime is loosened and removed. The ring can also accommodate a cleaning solution or soap between the prongs or teeth formed by the notches, This will also help to facilitate the loosening and removal of dirt and grime.

BRIEF DESCRIPTION OF DRAWINGS

For the purpose of illustrating the invention, there is shown in the drawings a form which is presently preferred; it being understood however, that this invention is not limited to the precise arrangements and instrumentalities shown.

Referring to the drawing in detail, wherein like numerals are utilized to indicate like elements, as shown below.

1. Ring
2. Convex outer surface
3. Flat inner surface
4. Notched or serrated edge
5. Vertical axis The following description is provided to enable any person skilled in art to make and use the invention and sets forth the mode contemplated.

Figure 1:
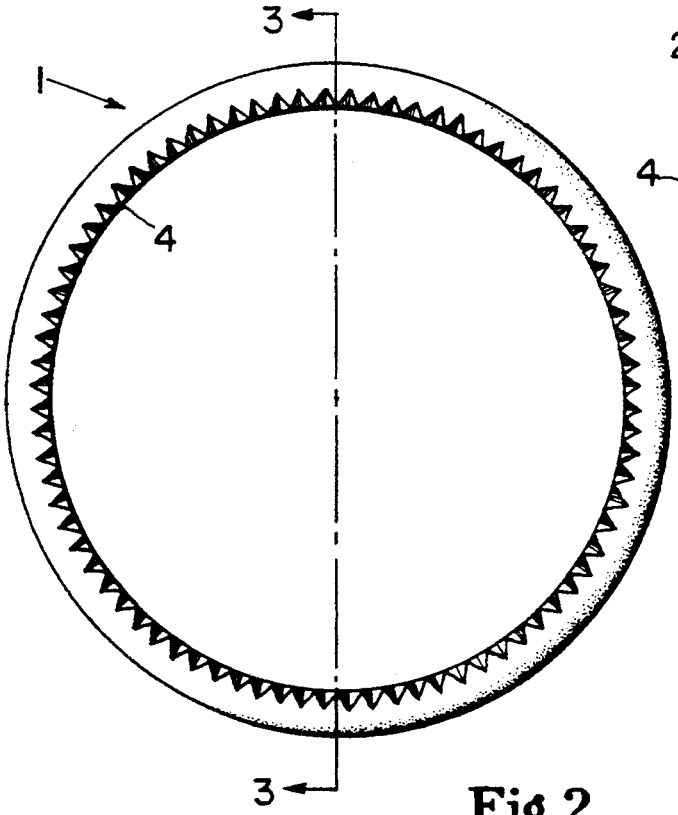
FIG. 1 is a plan view of a preferred embodiment or the present invention.

FIG. 1 shows a ring 1 with a continously notched or serrated edge 4 around the circumference of the ring 1. The ring 1 may have a diameter of 1" or the approximate diameter of the average persons ring finger.

Figure 2:
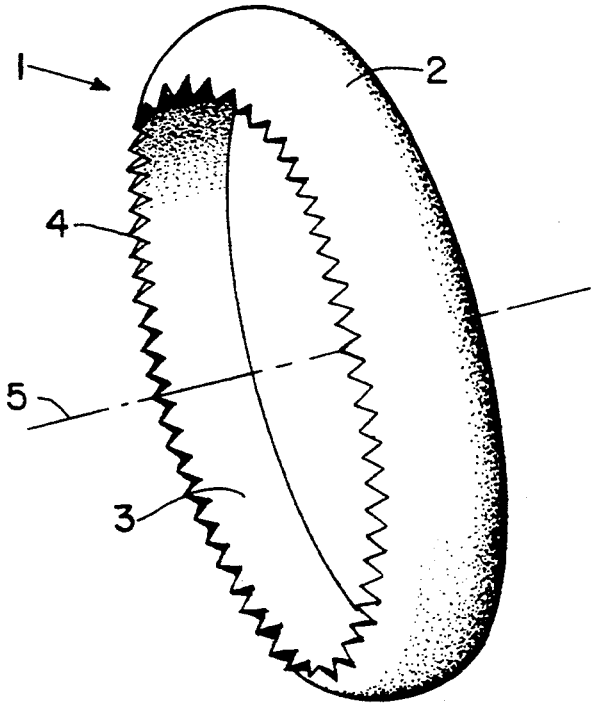
FIG. 2 is a perspective view of a preferred embodiment of the present invention.

FIG. 2 shows a continously notched or serrated edge 4 and the vertical axis 5 of the ring 1.

Figure 3:
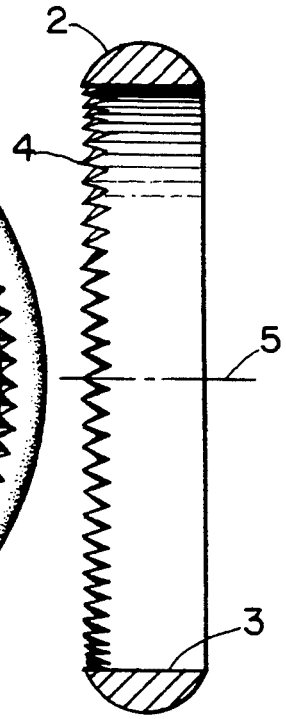
FIG. 3 is a cross-sectional view of a preferred embodiment of the present invention.

FIG. 3 shows a cross-section of the ring 1, taken along the lines A—A of FIG. 1, with the flat inner surface 3 and the convex outer surface 2 and the notched or serrated edge 4. The thickness of the ring 1 between the flat inner surface 3 and the convex outer surface 2 should be dimensioned to slip easily and snugly under the fingernail yet prevent the ring 1 from being forced too far up under the fingernail.

While the above description contains many specificities, these are not intended to be construed as limitations on the scope of the invention, but merely as exemplifications of the preferred embodiments thereof. Those skilled in the art will envision many other possible variations within its scope. For example, skilled artisans will readily be able to change dimensions, shapes, or positions of the various embodiments. Accordingly the reader is requested to determine the scope of the invention by the appended claim and their legal equivalents.

I claim:

1. The ring of the type having a generally annular shape, said ring comprising a generally cylindrical flat inner surface and a substantially transversely convex outer surface, said inner surface and said outer surface joining together at two substantially circular edges, one of said edges being substantially smooth, and the other of said edges being notched.

* * * * *